US005455613A

United States Patent [19]

Canfield et al.

[11] Patent Number: 5,455,613

[45] Date of Patent: Oct. 3, 1995

[54] THIN FILM RESISTOR PRINTHEAD ARCHITECTURE FOR THERMAL INK JET PENS

[75] Inventors: Brian P. Canfield, San Diego; David A. Johnson, Fallbrook, both of Calif.; John P. Harmon, Vancouver, Wash.

[73] Assignee: Hewlett-Packard Company, Palo Alto, Calif.

[21] Appl. No.: 204,799

[22] Filed: Mar. 2, 1994

Related U.S. Application Data

[63] Continuation of Ser. No. 905,971, Jun. 29, 1992, abandoned, which is a continuation-in-part of Ser. No. 606,667, Oct. 31, 1990, abandoned.

[51] Int. Cl.[6] ..... B41J 2/05

[52] U.S. Cl. ..... 347/65

[58] Field of Search ..... 347/65, 63, 62

[56] References Cited

U.S. PATENT DOCUMENTS

| | | | |
|---|---|---|---|
| 4,502,060 | 2/1985 | Rankin et al. | 347/65 R |
| 4,558,333 | 12/1985 | Sugitani et al. | 347/65 R |
| 4,611,219 | 9/1986 | Sugitani | 347/65 |
| 4,694,308 | 9/1987 | Chan et al. | 347/65 R |
| 4,794,410 | 12/1988 | Taub et al. | 347/65 R |
| 4,870,433 | 9/1989 | Campbell | 347/62 |
| 4,882,595 | 11/1989 | Trueba et al. | 347/65 R |
| 4,894,664 | 1/1990 | Tsung Pan | 347/63 |

*Primary Examiner*—Joseph W. Hartary

[57] ABSTRACT

A thermal ink jet printhead including a thin film substrate with a plurality of polygon shaped thin film resistors, a barrier layer overlying the substrate, and respective firing chambers formed in the barrier layer for each of the resistors. Each firing chamber is formed of a continuously curved concave wall having ends adjacent the boundary of the resistor, and which is within the boundary of the area defined by the resistor and a 10 micrometer wide margin around the resistor.

10 Claims, 2 Drawing Sheets

THIN FILM RESISTOR PRINTHEAD ARCHITECTURE FOR THERMAL INK JET PENS

This is a continuation of application Ser. No. 07/905,771, filed on Jun. 29, 1992, now abandoned, which is a continuation-in-part of U.S. application Ser. No. 07/606,667, filed Oct. 31, 1990 abandoned.

BACKGROUND OF THE INVENTION

This invention relates generally to the art and technology of thermal ink jet printing and more particularly to a new and improved thin film resistor (TFR) printhead architecture and geometry which is used in the manufacture of disposable thermal ink jet (TIJ) pens.

In the design of the thin film resistor printheads used in the manufacture of thermal ink jet pens, it has been a common practice to photolithographically define and electrically interconnect a plurality of heater resistors, such as those made of tantalum aluminum, on a thin film substrate and then construct a corresponding plurality of aligned firing chambers and associated orifice openings above and adjacent to the heater resistors. These firing chambers and orifice openings are used in ejecting ink from a region within the firing chambers and above the heater resistors and onto a print medium. As is well known, these firing chambers have commonly been constructed of a selected polymer material disposed on the TFR substrate and on top of which an orifice plate such as a gold plated nickel material is disposed and aligned with respect to the firing chambers. The polymer barrier layer is also photolithographically defined so as to have a predetermined firing chamber geometry and pattern adjacent to which an ink feed channel or port is used to fluidically connect each firing chamber with a source of ink supply.

In operation, electrical drive pulses are selectively applied to conductive traces leading into the various heater resistors situated in the bottom of each firing chamber to thereby heat the ink to boiling in each firing chamber and above each heater resistor. This resistor firing in turn produces a vapor bubble and a corresponding pressure field within the firing chamber used for thermally ejecting ink onto an adjacent print medium.

In the past, the cross-sectional geometry of the firing chambers defined by the walls of the polymer barrier located between the thin film resistor substrate and the orifice plate was partially rectangular in shape and typically of three sided wall construction. This construction defined the firing chamber areas surrounding the heater resistors on three sides thereof. These firing chambers and ink flow ports connected thereto serve not only to define an ink flow path and ink firing chamber for each heater resistor, but this architecture also serves to fluidically isolate adjacent heater resistors and thereby minimize undesirable crosstalk therebetween.

Examples of the above three sided rectangular shaped barrier layer geometries are those used in the three color disposable pen adapted for use in Hewlett Packard's PaintJet thermal ink jet printer. This disposable pen and the PaintJet thermal ink jet printer in which it has been successfully used are described in further detail in the *Hewlett Packard Journal*, Volume 39, No. 4, August 1988, incorporated herein by reference. The general architecture of the orifice plate and ink feed geometry for the above PaintJet pen is also described in U.S. Pat. No. 4,771,295, issued to Jeffrey P. Baker et al., assigned to the present assignee and also incorporated hereby by reference. In addition, both two-sided and three-sided barrier layer and firing chamber geometries have been used previously in other types of thermal ink jet pens such as those disclosed, for example, in U.S. Pat. Nos. 4,542,389 and 4,550,326, issued to Ross R. Allen, and U.S. Pat. No. 4,794,410, issued to Howard H. Taub, all assigned to the present assignee and also incorporated herein by reference.

Whereas the above Hewlett Packard thermal ink jet pen designs of three-sided barrier layer and firing chamber construction have performed quite satisfactorily under most conditions of operation, there are nevertheless certain situations where the above three-sided rectangular-shaped barrier layer designs have not been totally suitable for producing acceptably uniform ink drop volumes, printed dot and line uniformity and a corresponding acceptable print quality, particularly during the high frequency operation of the thermal ink jet pen when operating in a graphics mode. It is the solution to this problem to which the present invention is directed.

SUMMARY OF THE INVENTION

In accordance with the present invention, it has been discovered that a continuously curved concave firing chamber wall precisely aligned with respect to the geometry of the heater resistor produces a significant improvement in the uniformity and consistency of ink drop volumes being ejected from these firing chambers and associated orifice openings. This in turn results in a significant improvement in overall print quality. It is believed that the above previously unacceptable variations in printed dot size and corresponding drop volume produced by the earlier described thermal ink jet pens resulted from the fact that residual air from the vaporized fluid unnecessarily accumulated in both the rectangular corner and in the gaps between the barrier layer walls and the resistor edges of the earlier designed firing chambers.

When a thermal ink jet drop generator design allows the residual air and gases from previous printing cycles to accumulate on or near the heater resistor surface, this air and gas will provide low temperature nucleation sites on the heater resistor that will alter the time into the drive pulse width that ink vaporization begins. This alteration in turn will vary the pressure delivered to the ink being ejected from the printhead. Because ink drop volume surging within an ink firing chamber diminishes as the thermal ink jet firing frequency is reduced, it has been concluded that this alteration results from some time dependent process that diminishes after drop ejection, and the re-dissolution process of the residual air left over from the bubble vaporization process is such a time dependent process.

Accordingly, the general purpose and principal object of the present invention is to significantly improve the uniformity of ink drop volumes and corresponding dot and line sizes during thermal ink jet printing in both the text and graphics modes in order to improve the overall print quality of the hardcopy output. This purpose and object are achieved and accomplished by, among other things, the disposition of a novel-architecture barrier layer and ink firing chamber over a thin film resistor substrate having a plurality of polygon shaped heater resistors formed thereon. The barrier layer defines a plurality of ink firing chambers each formed by a continuously curved or arcuate concave wall that is laterally within the boundary of the region defined by the resistor and a 10 micrometer wide margin around the resistor. In this manner, the firing chamber wall is close to the sides of the resistor without having an excessive amount of the vertex portions of the resistor underlying the barrier layer.

An orifice plate is disposed on top of the barrier layer and has a corresponding plurality of orifice openings, with one orifice opening being aligned, respectively, with each firing chamber for ejecting uniform-volume ink drops therefrom during an ink jet printing operation.

Another object of this invention is to provide a new and improved thermal ink jet printhead of the type described wherein significant improvements in high frequency performance and resulting print quality can be achieved using as a minimum of process and design modifications to existing thermal ink jet printhead manufacturing processes and TIJ pen designs.

Another object is to provide a new and improved thermal ink jet printhead of the type described wherein the drop ejection stability and drop-to-drop consistency has been significantly improved with respect to known prior art TIJ pen designs.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
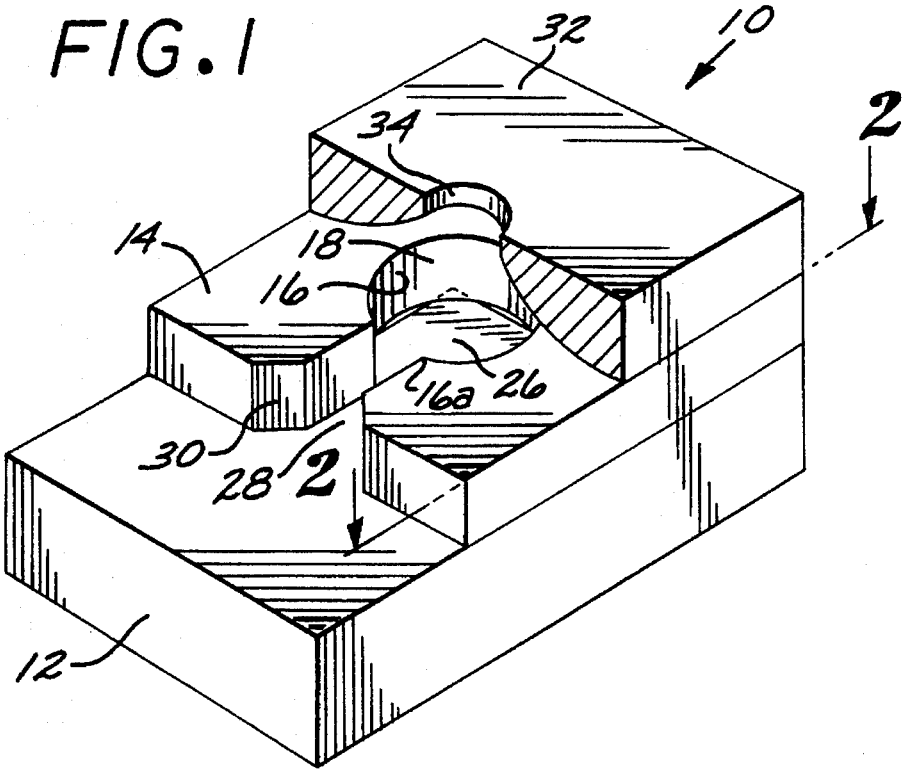
FIG. 1 is a partially cut away isometric view showing a thermal ink jet printhead that includes an improved firing chamber construction in accordance with the invention.

In the following detailed description and in the several figures of the drawing, like elements are identified with like reference numerals.

Referring now to FIG. 1, the thermal ink jet printhead shown therein is designated generally as 10 and includes a substrate member 12 upon which a polymer barrier layer 14 is disposed and configured in the geometry shown. The substrate 12 will typically be constructed of either glass or silicon or some other suitable insulating or semiconductor material which has been surface-oxidized and upon which a plurality of polygon shaped heater resistors 26 are photolithographically defined, for example in a layer of resistive material such as tantalum-aluminum. These heater resistors 26 are electrically connected by conductive trace patterns (not shown) which are used for supplying drive current pulses to these heater resistors during a thermal ink jet printing operation. In addition, there is also provided surface passivation and protection insulating layers (not shown) between the overlying polymer barrier layer 14 and the underlying heater resistors 26 and conductive trace patterns, and the details of this TIJ printhead construction are given in the above-identified *Hewlett Packard Journal*, Volume 39, No. 4, and also in the *Hewlett Packard Journal*, Volume 36, No. 5, May 1985, also incorporated herein by reference.

The polymer barrier layer 14 will typically be photodefined from a well-known polymeric material such as Vacrel available from the DuPont Company of Wilmington, Del., and using known photolithographic masking and etching processes which are used to define the geometry of the firing chamber 18. The firing chamber 18 is defined by a continuously curved or arcuate concave wall 16 that extends upwardly from the resistor and which has ends near the perimeter or boundary of the resistor. The ends of the continuously curved concave wall 16 form a single ink conveying opening into the firing chamber 18, and are connected to the sides of a rectangularly shaped ink feed channel 28 which extends as shown to receive ink at the slanted or angled lead-in end sections 30 that define an ink entry port of the polymer barrier layer 14. Thus, the firing chamber 18 is integrally joined to the rectangularly shaped ink feed channel 28 and associated ink flow entry port 30 which are operative to supply ink to the firing chamber 18 during drop ejection of ink from the thermal ink jet printhead.

The continuously curved concave firing chamber wall 16 overlies the resistor and is configured so that it remains within boundary of the area defined by the polygon shaped resistor and a 10 micrometer wide margin surrounding the polygon shaped resistor, whereby the continuously curved wall 16 remains close to the sides of the polygon shaped resistor. In other words, the continuously curved concave wall 16 is contained within the upward extension or projection of the perimeter of the region defined by the polygon shaped resistor and a 10 micrometer wide margin surrounding the resistor. Depending upon the implementation, the continuously curved concave wall 16 can pass inside of some of the vertices of the polygon shaped resistor. Also, the continuously curved wall can be completely within the boundary of the resistor, for example such that portions of the wall are tangential to some of the sides of the polygon shaped resistor.

Figure 2:
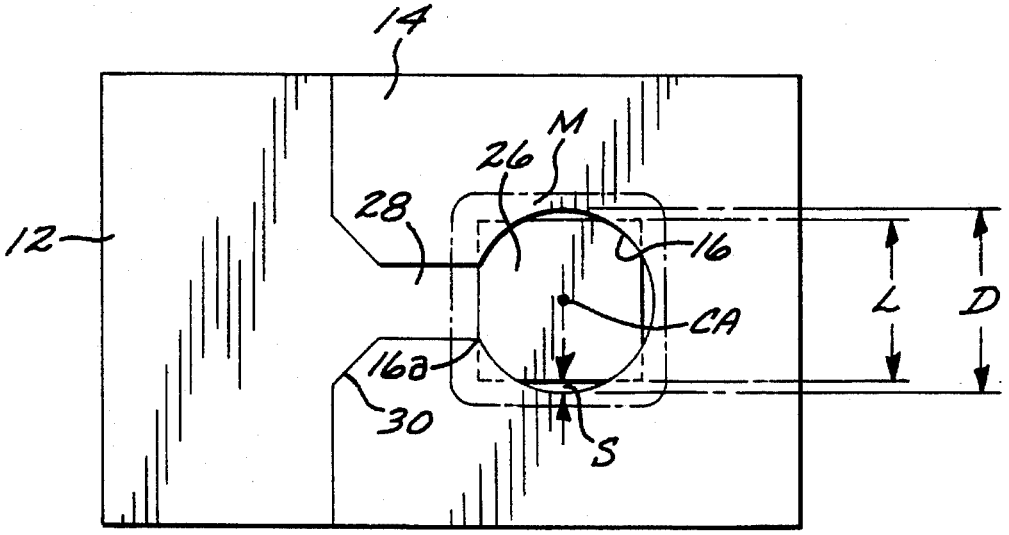
FIG. 2 is an abbreviated plan view of the firing chamber configuration of the thermal ink jet printhead of FIG. 1.

By way of illustrative example, FIG. 1 schematically illustrates an implementation of the invention with a square resistor 26 and a chamber wall 16 that is in the form of part of a circular cylinder, and FIG. 2 sets forth a schematic plan view thereof. The resistor 26 has a linear side dimension of L, for example in the range of about 35 to 60 micrometers, and the cylinder axis CA of the partial circular cylinder firing chamber wall 16 is substantially orthogonal to the resistor 26 (and to the plane of FIG. 2) and passes through the center of the square shape of the resistor 126. The barrier wall is a partial circular cylinder in the sense that the portion of the cylinder between the wall ends **16*a* has been removed. As illustrated in FIG. 2, a cross section of the partial circular cylinder comprises the major arc, on the circle that includes the cross section, between end points that are on the wall ends 16*a* which are adjacent to the perimeter of the resistor 26** and, by way of example, are spaced apart by less than the resistor side dimension L. The term "major" refers to the longer path between such end points on the circle that includes the cross section of the partially cylindrical wall. The cross section of the smaller portion of the cylinder that has been removed to provide an opening in the wall would be the minor arc between such end points.

Viewed another way, the partial circular cylinder wall is the larger portion of a circular cylinder that remains after the cylinder is sliced by a plane parallel to the cylinder axis CA and containing the wall ends **16*a***.

The partial circular cylinder wall 16 has a cylinder diameter D that is selected such that the wall remains within the boundary of the area defined by the square resistor 26 and a 10 micrometer wide margin M surrounding the resistor. In other words, to the extent that any portion of the chamber wall 16 is outside the resistor boundary, the radial distance S between the partial circular cylinder wall 16 and each of the resistor sides comprises the maximum spacing between a resistor side and an outboard portion of the partially cylindrical wall, and such radial distance S must be less that 10 micrometers. Thus, in accordance with the invention the cylinder diameter D is selected to be less than L+20 micrometers, and FIG. 2 illustrates the example wherein the cylinder diameter is less than L+20 micrometers and greater than L, whereby the wall 16 passes inside of the vertexes of the resistor.

Figure 3:
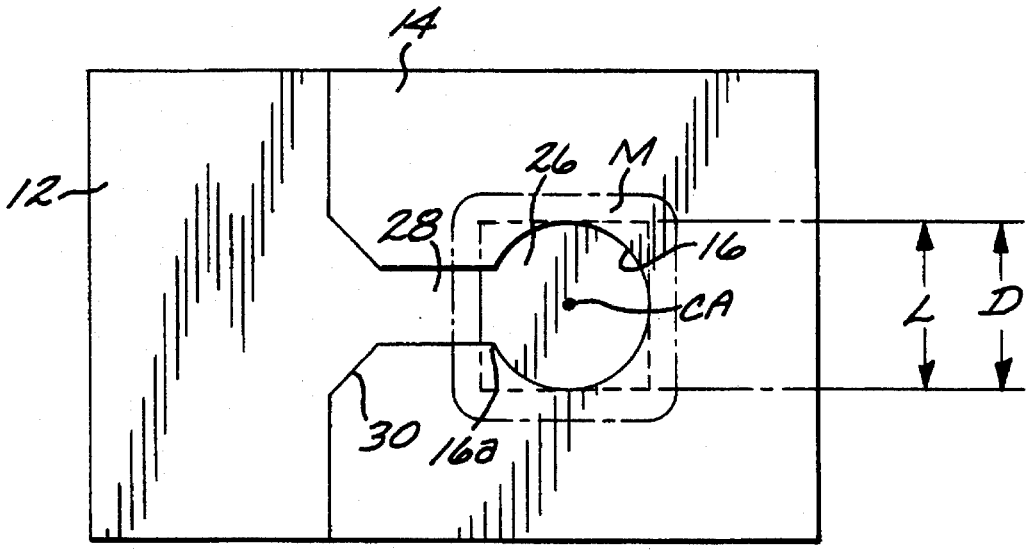
FIG. 3 is an abbreviated plan view of a further firing chamber configuration in accordance with the invention.

FIG. 3 illustrates, by way of further illustrative example, a square resistor having a side dimension L and an associated partial circularly cylindrical firing chamber wall having a cylinder diameter D that is substantially equal to L.

Figure 4:
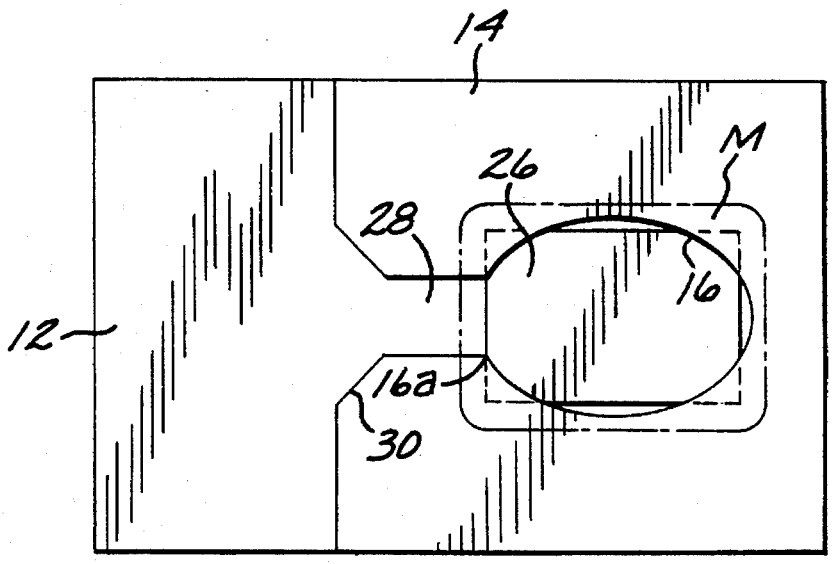
FIG. 4 is an abbreviated plan view of another firing chamber configuration in accordance with the invention.

FIG. 4 illustrates, by way of another example, a rectangular resistor and an associated firing chamber formed of a partial elliptical cylindrical barrier wall which is a partial ellipse in cross section.

Referring again to FIG. 1, an orifice plate 32 of conventional construction and fabricated typically of gold plated nickel is disposed as shown on the upper surface of the polymer barrier layer 14, and the orifice plate 32 has a convergently contoured orifice opening 34 therein which is typically aligned with the center of the heater resistor 26. However, in some cases the orifice opening 34 may be slightly offset with respect to the center of the heater resistor in order to control the directionality of the ejected ink drops in a desired manner.

In accordance with the present invention, it has been discovered that considerable improvements in ink drop generation stability and drop-to-drop volume consistency for enhancing overall print quality is obtained with the foregoing relation between the continuously curved concave wall 16 and the underlying square resistor 26. With such configuration, the residual air and gases from previous printing cycles are not allowed to significantly accumulate on or near the heater resistor surface and thereby produce undesirable pressure variants in the firing chamber 16. Such undesirable pressure variations would otherwise be delivered to the fluid being ejected and contribute to the overall detriment of drop-to-drop volume consistency and drop ejection stability. The improved performance of this novel architecture manifests itself in a clearly visible improvement in the clarity, uniformity and print quality of the printed media.

Although the foregoing has been a description and illustration of specific embodiments of the invention, various modifications and changes thereto can be made by persons skilled in the art without departing from the scope and spirit of the invention as defined by the following claims.

What is claimed is:

1. A thermal ink jet printhead comprising:

a thin film substrate with a plurality of thin film resistors each substantially polygon shaped in plan view;

a barrier layer overlying the substrate; and respective firing chambers formed in said barrier layer for each of the resistors;

each firing chamber formed by a continuously arcuate concave barrier wall that is within the boundary of an area defined by the resistor and a 10 micrometer margin around the resistor, said barrier wall having ends adjacent the perimeter of the associated resistor and forming a single opening into said firing chamber.

2. The thermal ink jet printhead of claim 1 wherein portions of said barrier wall are inside of the perimeter of the associated resistor.

3. The thermal ink jet printhead of claim 1 wherein portions of said barrier wall are outside of the perimeter of the associated resistor.

4. The thermal ink jet printhead of claim 1 wherein each of said resistors is square, and wherein each of said firing chambers is formed of a barrier wall that is a partial circular cylinder.

5. The thermal ink jet printhead of claim 4 wherein said barrier wall passes on the inside of the vertexes of the associated resistor.

6. The thermal ink jet printhead of claim 1 wherein each of said resistors is rectangular, and wherein each of said firing chambers is formed of a wall that is a partial elliptical cylinder.

7. The thermal ink jet printhead of claim 6 wherein said barrier wall passes on the inside of the vertexes of the associated resistor.

8. A thermal ink jet printhead comprising:

a thin film substrate with a plurality of thin film resistors each substantially square shaped in plan view and each having a side dimension L;

a barrier layer overlying the substrate; and respective firing chambers formed in said barrier layer for each of the resistors;

each firing chamber formed of a partial circular cylinder barrier wall having a cylinder axis that passes through the center of the square shape of the associated resistor and a diameter that is less than L+20 micrometers, said barrier wall having ends adjacent the perimeter of the associated resistor and forming a single opening into said firing chamber.

9. The thermal ink jet printhead of the claim 8 wherein said cylinder diameter is greater than the resistor side dimension L and less than L+20 micrometers.

10. The thermal ink jet printhead of the claim 8 wherein said cylinder diameter is substantially equal to the resistor side dimension L.

* * * * *